US010458226B2

(12) United States Patent
Kuroiwa et al.

(10) Patent No.: US 10,458,226 B2
(45) Date of Patent: Oct. 29, 2019

(54) SHOCK AND VIBRATION DAMPER SYSTEM AND METHODOLOGY

(71) Applicant: Schlumberger Technology Corporation, Sugar Land, TX (US)

(72) Inventors: Sogo Kuroiwa, Cambridge, MA (US); Tsuyoshi Yanase, Tokyo (JP); Juei Igarashi, Kanagawa-ken (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 214 days.

(21) Appl. No.: 15/415,330

(22) Filed: Jan. 25, 2017

(65) Prior Publication Data

US 2017/0226845 A1 Aug. 10, 2017

Related U.S. Application Data

(60) Provisional application No. 62/292,350, filed on Feb. 7, 2016.

(51) Int. Cl.
*E21B 17/00* (2006.01)
*E21B 47/01* (2012.01)

(52) U.S. Cl.
CPC ..... *E21B 47/011* (2013.01); *E21B 17/006* (2013.01)

(58) Field of Classification Search
CPC ..... E21B 47/011; E21B 7/24; E21B 17/07
See application file for complete search history.

(56) References Cited

U.S. PATENT DOCUMENTS 3,122,902 A * 3/1964 Blair ..... E21B 17/07 464/21
3,164,041 A * 1/1965 Carlstedt ..... B23B 29/022 408/144
3,207,009 A * 9/1965 Carlstedt ..... B23B 29/022 188/380
3,323,326 A * 6/1967 Vertson ..... E21B 17/07 175/323
3,503,224 A * 3/1970 Davidescu ..... E21B 17/07 464/20
3,559,512 A * 2/1971 Aggarwal ..... B23B 29/022 188/322.5
3,690,414 A * 9/1972 Aggarwal ..... B23Q 11/0032 188/378
3,774,731 A * 11/1973 Zerb ..... E21B 17/07 188/268
3,938,626 A * 2/1976 Hopkins ..... B23B 29/022 188/378

(Continued)

FOREIGN PATENT DOCUMENTS

CA 2990458 A1 * 1/2017 ..... E21B 17/003
EP 3112584 A1 * 1/2017 ..... E21B 43/116

*Primary Examiner* — Jennifer H Gay

(57) ABSTRACT

A technique facilitates protection of a sensitive component, e.g. a well tool component, against shock and vibration. The sensitive component may be positioned in a mechanical chassis which is mounted in a housing. The mechanical chassis is mounted in the housing via a damper system which may comprise various vibration and shock absorbing components, such as a vibration damper, a transverse shock damper, and/or an axial damper. In drilling applications, the housing may be coupled into a drill string although the damper system may be used in other types of applications.

16 Claims, 5 Drawing Sheets

(56) References Cited

U.S. PATENT DOCUMENTS 4,553,884 A * 11/1985 Fitzgerald ..... B23B 29/022 408/143
4,630,809 A * 12/1986 Duckworth ..... E21B 17/07 267/125
4,779,852 A * 10/1988 Wassell ..... E21B 47/011 166/319
6,412,614 B1 * 7/2002 Lagrange ..... E21B 17/07 175/293
6,439,055 B1 * 8/2002 Maron ..... G01L 9/06 73/705
6,557,631 B1 * 5/2003 Spencer ..... E21B 23/08 166/153
7,028,997 B2 * 4/2006 Takahashi ..... B23B 29/022 267/137
8,950,513 B2 * 2/2015 Montgomery ..... E21B 17/1014 175/325.2
2003/0050387 A1 * 3/2003 Fujisawa ..... C08F 283/12 524/588
2008/0066965 A1 * 3/2008 Pabon ..... E21B 17/07 175/56
2009/0014166 A1 * 1/2009 Cheeseborough .... E21B 47/011 166/65.1
2010/0181111 A1 * 7/2010 Bowar ..... E21B 17/07 175/56
2010/0224410 A1 * 9/2010 Wassell ..... E21B 17/07 175/40
2011/0186284 A1 * 8/2011 Jekielek ..... E21B 47/011 166/65.1
2012/0085581 A1 * 4/2012 Wassell ..... E21B 17/07 175/40
2012/0247832 A1 * 10/2012 Cramer ..... E21B 47/011 175/40
2013/0004250 A1 * 1/2013 Gamble ..... B23C 5/003 407/40
2013/0168092 A1 * 7/2013 Evans ..... E21B 31/107 166/301
2014/0319330 A1 * 10/2014 Berheide ..... G01T 3/06 250/269.5
2015/0376959 A1 * 12/2015 Dinica ..... E21B 17/07 175/56
2016/0146288 A1 * 5/2016 Freyermuth ..... B23C 5/003 267/140.13
2017/0149322 A1 * 5/2017 Lin ..... H02K 37/22
2017/0167205 A1 * 6/2017 Saeed ..... E21B 7/24
2017/0226845 A1 * 8/2017 Kuroiwa ..... E21B 17/006
2018/0100357 A1 * 4/2018 Christopher ..... E21B 17/07
2018/0179830 A1 * 6/2018 Konschuh ..... E21B 17/07

* cited by examiner

| Transverse shock | Case 1 | Case 2 | Case 3 |
|---|---|---|---|
| Transmissibility | ~1.3 | ~1.9 | ~1.25 |

SHOCK AND VIBRATION DAMPER SYSTEM AND METHODOLOGY

CROSS REFERENCE TO RELATED APPLICATION

This application claims priority to and the benefit of U.S. Provisional Patent Application No. 62/292,350, filed on Feb. 7, 2016, the entirety of which is incorporated herein by reference.

BACKGROUND

Oil and natural gas production often involves the drilling of a wellbore or wellbores into a hydrocarbon bearing formation, sometimes referred to as a reservoir. Various types of equipment may be deployed along a drill string to facilitate drilling of the desired wellbore. For example, drill strings may incorporate various sensors and telemetry systems which provide formation and/or equipment related data uphole to a surface control system.

The sensors may be used in measurement-while-drilling, logging-while-drilling, and other while-drilling tools to obtain the desired data. However, the reliability of these types of tools may be affected by the harsh drilling activities and environments. In addition to exposure to high temperature downhole environments, the various sensing tools and other tools may be subjected to drilling-driven shock and vibration. The shock and vibration can negatively affect the reliability and longevity of the downhole tool or tools.

SUMMARY

In general, a system and methodology are provided to protect a sensitive component, e.g. a well tool component, against shock and vibration. The sensitive component may be positioned in a mechanical chassis which is mounted in a housing. The mechanical chassis is mounted in the housing via a damper system which may comprise various vibration and shock absorbing components, such as a vibration damper, a transverse shock damper, and/or an axial damper. In drilling applications, the housing may be coupled into a drill string although the damper system may be used in other types of applications.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which enhance protection of a sensitive component, e.g. a vibration susceptible well tool component, against shock and vibration. According to an embodiment, the sensitive component is positioned in a mechanical chassis which is mounted in a corresponding housing. Depending on the application, the sensitive component may be mounted within or in cooperation with the mechanical chassis and is protected by the mechanical damping provided with respect to the mechanical chassis. For example, the mechanical chassis may be mounted in the housing via a damper system comprising vibration and shock absorbing components. Examples of the vibration and shock absorbing components include a vibration damper, a transverse shock damper, and/or an axial damper. In drilling applications, the housing may be coupled into a drill string although the damper system may be used in other types of applications.

In oilfield applications, the damper system may be used to provide comprehensive damper mechanics against transportation related and/or drilling-driven mechanical shocks and vibrations acting against the vibration sensitive components. Examples of vibration sensitive components include sensor modules, electronics, data transmission equipment, and/or other systems or devices that would be susceptible to the harsh shock and vibration occurring in drilling environments or certain other environments.

The damper system enhances the reliability and longevity of these types of vibration sensitive components. In data collection and transmission applications, the damper system also may serve to improve data quality with respect to measurements obtained during a drilling or sliding operation by protecting data accumulation and transmission devices from shock and vibration. For example, the damper system may facilitate accumulation of quality data during geosteering surveying as well as during tool face monitoring based on magnetometer, gyroscope, and/or accelerometer measurements.

Figure 1:
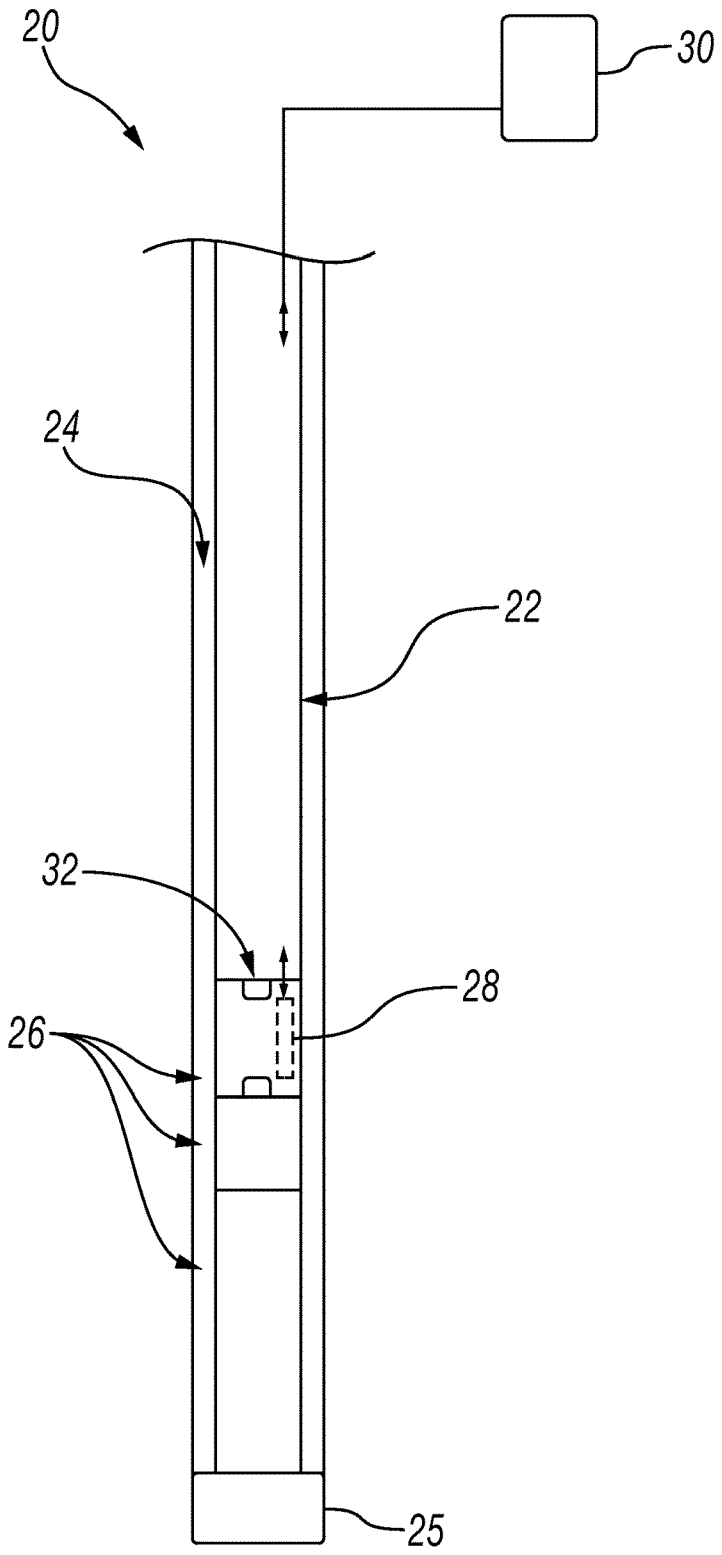
FIG. 1 is a schematic illustration of an example of a damper system deployed downhole in a well system, according to an embodiment of the disclosure.

Referring generally to FIG. 1, an example of a well system 20 is illustrated as comprising a well string 22, e.g. a drill string, disposed in a borehole 24. In a drilling application, the drill string 22 comprises a drill bit 25 which is rotated to enable drilling of borehole 24. In this example, the well string 22 comprises a plurality of well string components 26, e.g. tools, selected according to the parameters of a given well application. In the illustrated application, at least one of the well string components 26 comprises a vibration sensitive component 28 which may include electronics, sensors, and/or other devices susceptible to shock and vibration.

In some applications, the vibration sensitive component 28 may be part of a while-drilling system, such as a measurement-while-drilling or a logging-while-drilling system, which transmits measurement data and/or other data. For example, the vibration sensitive component 28 may be in the form of a while-drilling measurement system for communicating data with a control system 30, such as a computer-based control system located at the surface. A damper system 32 is used in conjunction with or combined with the corresponding well string component 26 to protect the vibration sensitive component 28.

Figure 2:
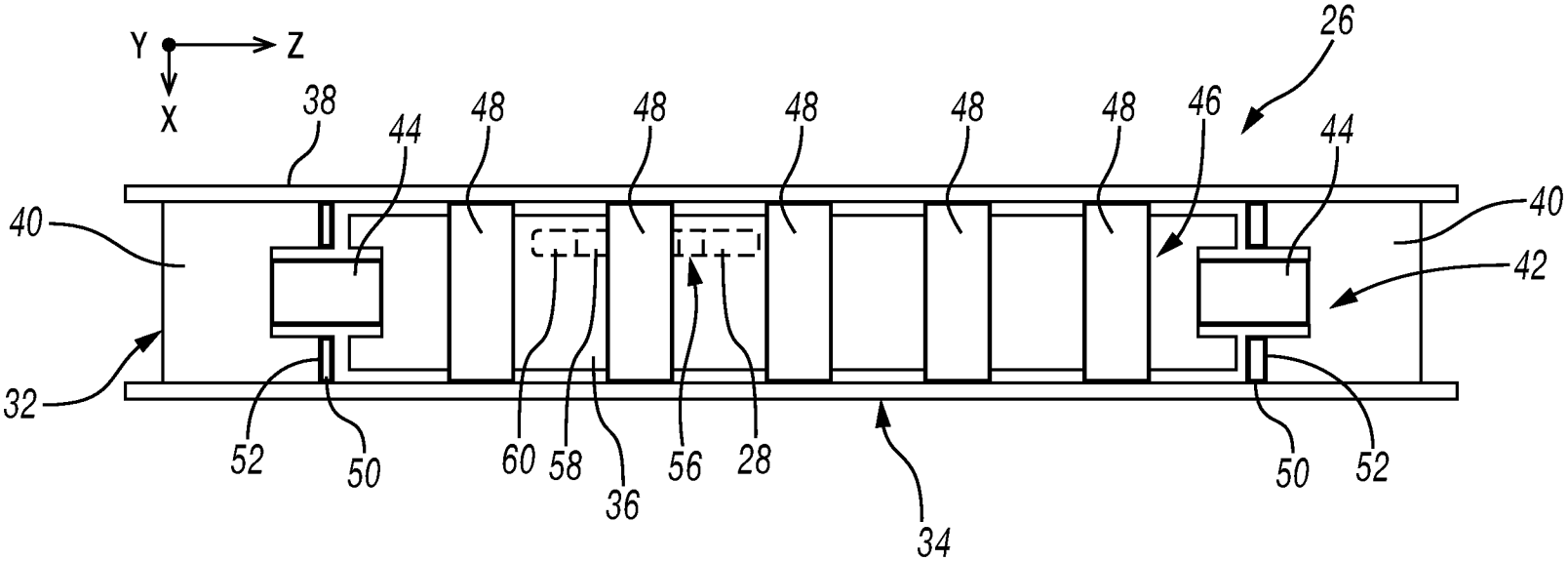
FIG. 2 is a schematic illustration of an example of a damper system, according to an embodiment of the disclosure.

Referring generally to FIG. 2, an example of one type of well string component 26 incorporating a damper system 32 is illustrated. In this example, the well string component 26 comprises a housing 34 and a mechanical chassis 36 engaged with the vibration sensitive component 28. In some applications, the housing 34 and the mechanical chassis 36 may each be formed from a metal material and the damper system 32 may be arranged to limit or prevent metal-to-metal contact between the housing 34 and the mechanical chassis 36.

Effectively, the mechanical chassis 36 is able to float within housing 34 so as to avoid high-frequency noise due to, for example, metal-to-metal contact resulting from external shocks and vibration. The physical connection between the mechanical chassis 36 and the housing 34 can be achieved via the damper system 32. In the illustrated example, the vibration sensitive component 28 may comprise electronics and/or sensors and may be mounted to, e.g. within, the mechanical chassis 36.

Depending on the application, the housing 34 may be constructed in various forms. By way of example, the housing 34 may comprise a tubular section 38 disposed around the mechanical chassis 36. Additionally, the housing 34 may comprise a pair of transverse components 40, e.g. bulkheads, positioned within the tubular section 38 on opposite axial ends of mechanical chassis 36. Similarly, the mechanical chassis 36 may be constructed in a variety of sizes and configurations depending on the parameters of a given application and of the vibration sensitive component 28.

Damper system 32 may incorporate features and materials selected for both damping performance and for high-temperature capabilities to enable use in downhole environments. In the example illustrated, the damper system 32 comprises a vibration damper 42 constructed to provide vibration damping with low-pass filter functionality, instantaneous transverse and axial shock damping, and attitude control of the internal mechanical chassis 36. By way of example, the vibration damper 42 may comprise a pair of vibration damper components 44 in which each damper component 44 is coupled between an axial end of the mechanical chassis 36 and the corresponding bulkhead 40 of housing 34 such that the damper components 44 are disposed at opposite axial ends of the mechanical chassis 36.

In the example illustrated, the damper system 32 also may comprise a transverse shock damper 46 which may be disposed transversely, e.g. radially, between the mechanical chassis 36 and the housing 34. The transverse shock damper 46 is positioned to provide damping with respect to transverse shock loads acting against housing 34. In various applications, the transverse shock damper 46 is helpful in damping vibrations by suppressing ringing effects.

The transverse shock damper 46 may be constructed in various configurations. In the example illustrated, however, the transverse shock damper 46 comprises a plurality of bands 48 disposed about the mechanical chassis 36 and radially between the mechanical chassis 36 and the surrounding tubular section 38 of housing 34. In some applications, the bands 48 may be constructed to enable small radial clearances between the mechanical chassis 36 and the surrounding housing 34. For example, the bands 48 may be constructed with a thickness ranging from a couple of millimeters to tens of millimeters, e.g. 2-30 mm.

In some applications, the damper system 32 also may comprise an axial shock damper 50 positioned to provide axial shock damping. For example, the axial shock damper 50 may comprise separate shock absorbing components 52 mounted along corresponding bulkheads 40 and oriented toward the axial ends of mechanical chassis 36. In this position, the shock absorbing components 52 are able to limit the transfer of axial shock loads from housing 34 to mechanical chassis 36.

Depending on the application, the shock absorbing components 52 may be in the form of plates or rings having a thickness ranging from a few millimeters to tens of millimeters, e.g. 2-30 mm. As with the other components of damper system 32, the axial shock damper 50 limits the shock and vibration effects to mechanical chassis 36 and vibration sensitive component 28 when shock loads (and vibration) are incurred by housing 34 during, for example, transportation or drilling operations.

The damper mechanisms 42, 46, 50 of damper system 32 thus play their designated roles in mitigating the effects of external disturbances on the overall drill string component 26. Depending on the application, the mechanical chassis 36 and damper system 32 may be configured and arranged to protect various types of vibration sensitive components 28. By way of example, the types of vibration sensitive components 28 which are protected may comprise electronic components 56, e.g. sensors 58 and/or telemetry devices 60.

In a variety of drilling operations, drilling related noise is created and vibrations are induced at the drilling assembly, e.g. at a bottom-hole assembly, during drilling and sliding modes. The vibration may comprise radial and axial accelerations with dominant energy bands from tens of hertz up to or above 100 Hz. The damper system 32, however, effectively provides a mechanical low-pass filter with a cut-off frequency on the order of tens of hertz so as to minimize the vibrational influence passed through to the mechanical chassis 36.

Additionally, the material used to construct the components of damper system 32 may be selected to provide a specially tuned damper to enhance the effectiveness of damper system 32 during drilling and sliding modes. The data quality and accuracy of data transmitted by certain vibration sensitive components 28, e.g. while-drilling components, also can be improved by the reduction of such vibration noise.

To provide the desired mechanical low-pass filter for a variety of downhole equipment applications, the damper system 32 may comprise components, e.g. components 42, 46, 50, formed from a material having a hardness in the range of Shore hardness A 10-90. The material hardness is selected to provide the desired cut-off frequency for shock and vibration reduction while still enabling attitude control with respect to the mechanical chassis 36. Examples of suitable materials comprise silicone gel materials having the desired hardness.

For a variety of applications, suitable silicone gel materials include the series of materials known as the αGEL® series of materials available from TAICA Corporation. The αGEL® silicone gel materials are relatively temperature-independent compared to a variety of other resilient materials, at least within the range of temperatures found in downhole environments (e.g. temperatures up to approximately 300° C.).

In some applications, the suitable material may comprise a urethane-based material, such as an ether-series or ester-series urethane-based material. Additionally, certain rubber materials, e.g. silicon rubber materials, may be used as the damping material in some applications. The same material or different materials may be used for the vibration damper 42, transverse shock damper 46, and axial shock damper 50 depending on the parameters of a given application. In some applications, for example, a desired silicone gel material may be used to form vibration damper components 44 of vibration damper 42 while other types of shock absorbing material are used to construct the transverse shock damper 46 and the axial shock damper 50.

Figure 3:
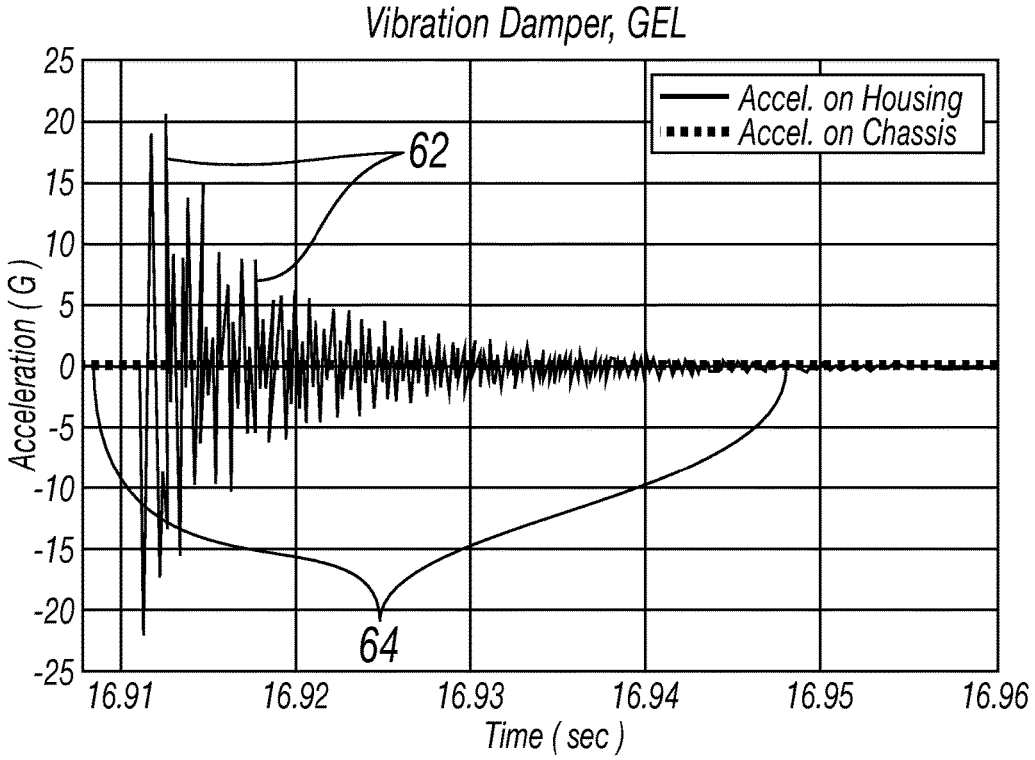
FIG. 3 is a graphical illustration showing time domain spectra of acceleration signals with respect to a mechanical chassis and a housing of the damper system, according to an embodiment of the disclosure.

According to a specific example, an αGEL® silicone gel material was used to construct vibration damper 42 and vibration damping performance was evaluated by examining a ratio of external vibration noise between the mechanical chassis 36 and the housing 34, which is equivalent to a noise transfer function. FIG. 3 provides a graphical illustration showing the vibration transferred to the mechanical chassis 36.

In FIG. 3, the resulting time domain spectra of acceleration response on the housing 34 is represented by graph line 62 and the time domain spectra of acceleration response on the mechanical chassis 36 is represented by graph line 64. The time domain spectra clearly indicate that this type of silicone gel material provides a considerable damping effect. The material provides high suppression of both first instantaneous shock impact and residual vibration over time.

Accordingly, the silicone gel material provides desirable damping performance, desirable cut-off frequency, high-temperature endurance, and acceptable cost. However, other types of material can be used in certain applications and/or for other components of the overall damper system 32.

Figure 4:
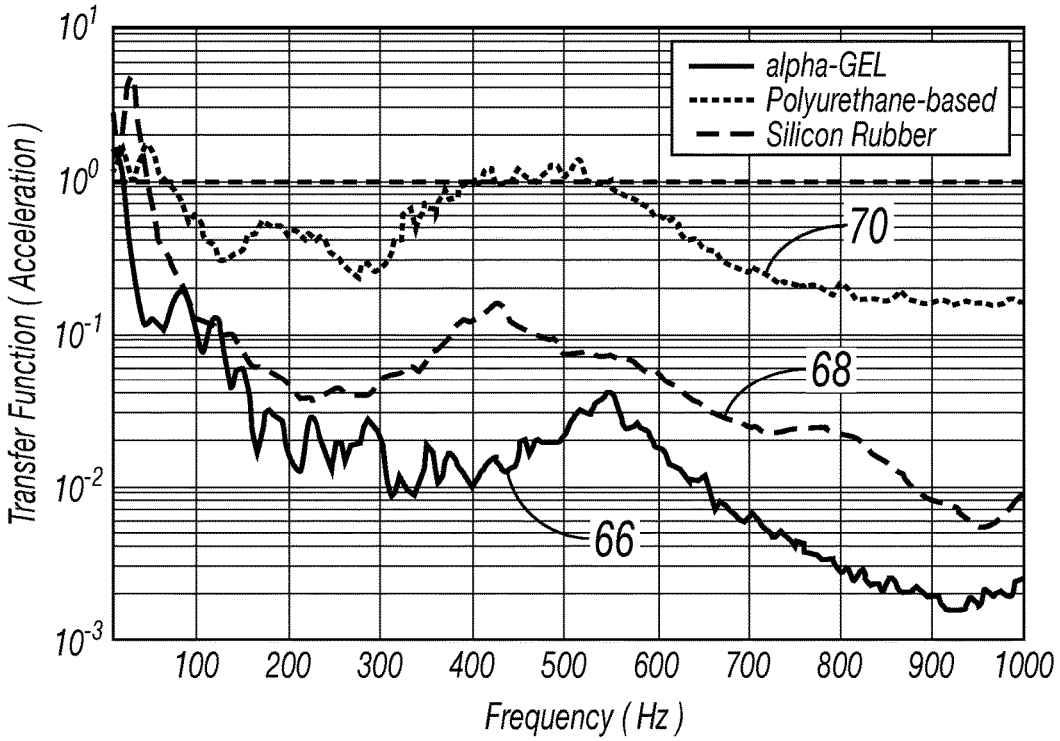
FIG. 4 is a graphical illustration a transfer function based on acceleration output as a function of frequency for a damped tool, according to an embodiment of the disclosure.

Referring to FIG. 4, a graphical illustration is provided which presents material dependence of the vibration damper 42 as a function of frequency response of the transfer function. The materials represented comprise silicone gel, i.e. αGEL® silicone gel, represented by graph line 66; silicon rubber, represented by graph line 68; and polyurethane-based elastomeric material, represented by graph line 70. The silicon rubber graph line 68 shows damping above 50 Hz with an observed resonance peak at a frequency below 50 Hz due to ringing. The silicone gel represented by graph line 66 provides a better damped resonance peak and also provides very good low-pass filter performance for a wide frequency range, e.g. approximately −20 dB up to 100 Hz, −40 dB up to 500 Hz, and −60 dB above 1000 Hz. In this example, the polyurethane-based damping material represented by graph line 70 showed a relatively reduced vibration damping performance.

However, damper system 32 may be constructed in whole or in part from these and other materials depending on the parameters of a given application. In a variety of downhole applications, however, the silicone gel provides substantial damping performance while also resisting degradation following exposure to high-temperature environments for substantial lengths of time. For example, the αGEL® silicone gel showed little or no degradation after exposure to temperatures of 155° C. for 100 or more hours.

Figure 5:
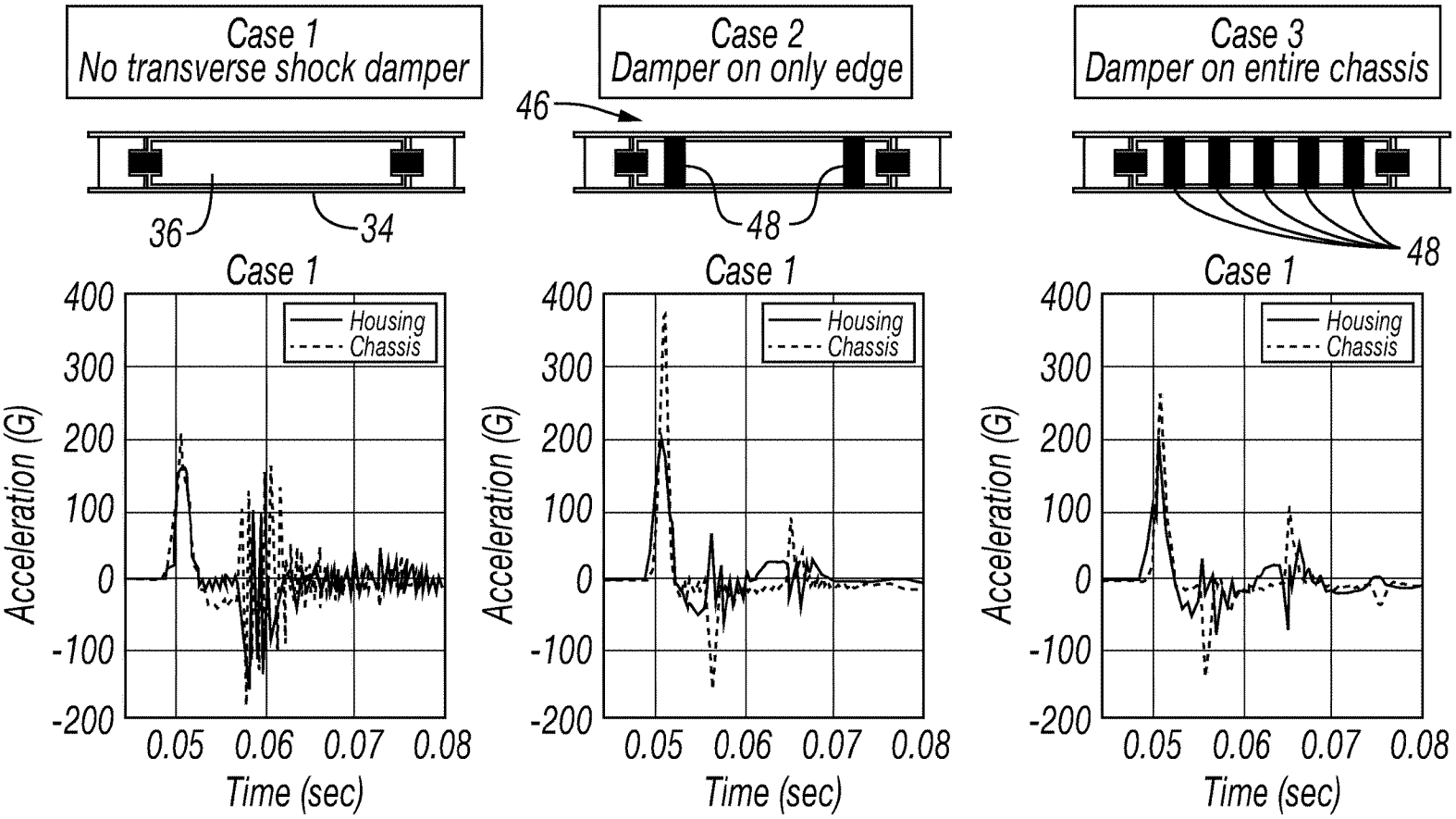
FIG. 5 is a series of graphical illustrations illustrating time versus acceleration for different damper configurations and also a shock profile for each damper configuration, according to an embodiment of the disclosure.

In addition to risks associated with vibration induced by the drilling or sliding mode during a drilling operation, instantaneous shock also may have a deleterious effect on the reliability of downhole well string components 26 (see FIGS. 1 and 2). The vibration damper 42 (see FIG. 2) provides substantial protection against shock and vibration by providing a cut-off for high-frequency noise. However, further protection can be provided by utilizing features to absorb transverse and axial shocks, e.g. transverse shock damper 46 and axial shock damper 50 (see FIG. 2). Referring generally to FIG. 5, graphical representations have been provided to show the added protection against shock and vibrational loads, the protection resulting from the addition of transverse shock damper 46. In this example, the αGEL® silicone gel was used to construct the transverse shock damper 46.

The graphical illustrations of FIG. 5 provide three different scenarios. In the first case, represented on the left side of the figure, the mechanical chassis 36 has been positioned within housing 34 without transverse shock damper 46. As illustrated by the corresponding graph, a greater degree of vibrational ringing was observed on both the housing 34 and the mechanical chassis 36 for several milliseconds after arrival of an initial shock loading.

The vibrational ringing can be substantially suppressed by adding transverse shock damper 46 in the form of a pair of bands 48, as represented in the second case illustrated in the middle of FIG. 5. In the third case, represented on the right side of FIG. 5, the transverse shock damper 46 has been constructed with five bands 48. In this latter case, the vibrational ringing on the mechanical chassis 36 as well as the shock loading experienced by the mechanical chassis 36 has been substantially reduced.

It should be noted the shock and vibrational profiles graphically illustrated in FIG. 5 were obtained by placing accelerometers on the surfaces of both the housing 34 and the mechanical chassis 36, and the data acquisition was performed using a Keyence Wave logger acquisition system.

Figure 6:
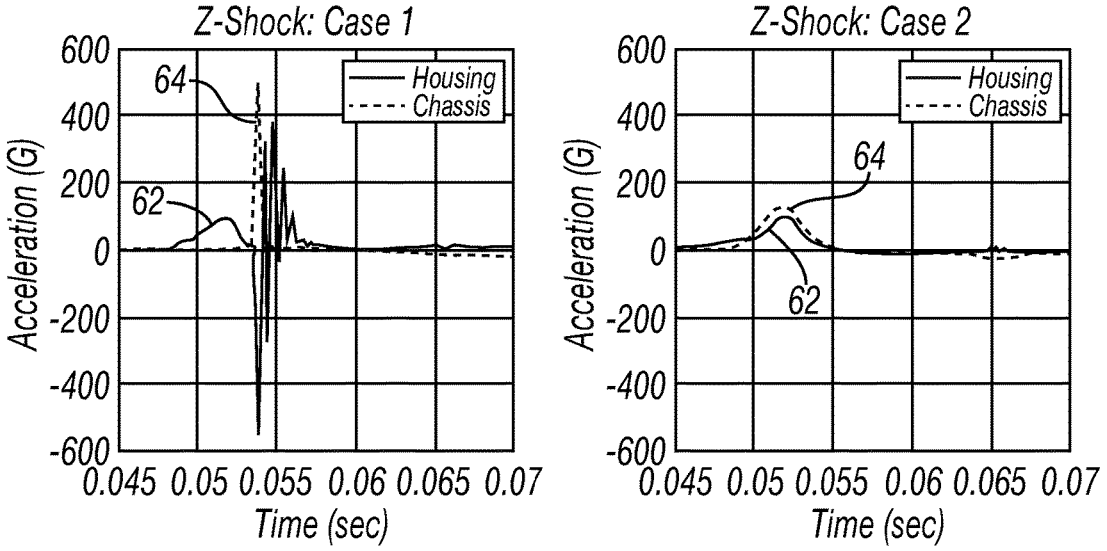
FIG. 6 is a graphical illustration showing axial shock profiles for a mechanical chassis and a housing without damping and with damping via the damper system, according to an embodiment of the disclosure.

In various applications, the shock loading passed through to the mechanical chassis 36 can be further reduced via axial shock damper 50 (see FIG. 2). In FIG. 6, shock transmissibility to the mechanical chassis 36 has been illustrated for two different scenarios. In the first case, no axial shock damper 50 has been positioned between housing 34 and mechanical chassis 36. Axial accelerations 62, 64 occur with respect to the housing 34 and the mechanical chassis 36 due to a shock to the housing 34, and those accelerations have been illustrated on the left side of FIG. 6.

In the second case, axial shock damper 50 has been added in the form of shock absorbing components 52, and the accelerations 62, 64 have been illustrated on the right side of FIG. 6. In this example, the αGEL® silicone gel was used to construct the axial shock damper 50.

As illustrated, without axial shock damper 50 the shock impact on the housing 34 which is transmitted to the mechanical chassis 36 is amplified from approximately 100 G to approximately 500 G, thus corresponding to a transmissibility factor of 5.0 with some time delay. Additionally, even though the shock input peaks have a broad response (about 5 ms duration), the mechanical chassis response becomes quite sharp (about 1 ms duration).

The sharp response may be due to metal-to-metal impact between the housing 34 and the mechanical chassis 36. In this example, the shock peak having approximately a 1 ms duration is comparable to peak energy having 1 kHz frequency. A variety of circuit boards and corresponding electronics for downhole usage have a first bending resonance mode of approximately 1 kHz. Accordingly, the illustrated 1 ms shock peak can amplify the displacement and/or shear stress acting on the circuit board due to the structural resonance effect. This phenomenon increases the likelihood of electronics failure.

As further illustrated on the right side of FIG. 6, the shock transmissibility when using axial shock damper 50 is substantially reduced from approximately 5.0 to approximately 1.2. The acceleration profile of the internal chassis 36 substantially follows that of the external housing 34 without acceleration of the shock impact. Consequently, less shock loading is transmitted to mechanical chassis 36 and, in turn, less shock loading is transmitted to the vibration sensitive component 28, e.g. electronics, which may be carried by or coupled with the mechanical chassis 36.

By selecting the appropriate damping component construction and damping component material, e.g. αGEL® silicone gel, substantially enhanced damping performance against shock and vibration can be achieved. The enhanced damping performance protects electronics, sensors, and/or other vibration and shock sensitive components 28 during, for example, drilling operations, sliding operations, and/or transportation of the components. In downhole applications, suitable damping materials can be selected which provide consistent damping performance and are substantially insensitive to the changes in temperature experienced in downhole applications.

The selection of materials and the various components of damper system 32 do not simply improve the reliability and longevity of the susceptible component 28 but also can improve data quality and accuracy. In while-drilling measurement applications, for example, the reduction of shock and vibrational loads can improve the quality and accuracy of data transmitted uphole to control system 30.

For example, the damper system 32 may be used to protect components 28 which are in the form of sensor units used for continuous surveying, navigation, and/or trajectory control. The damper system 32 may be used to reduce the mechanical shocks and vibrations transmitted to the sensor unit/component 28 while maintaining sensor alignment. Examples of such sensors include magnetometers, accelerometers, and/or gyroscopes.

The vibration damper 42 and/or other vibration damping components of damper system 32 also may used to provide the desired mechanical low-pass filter so that the angle measurement error is reduced for these types of sensors. The angle measurement error may be due to saturation of the sensor electronics dynamic range or due to exceeding the electronics frequency bandwidth of the sensor. In perforating applications, the damper system 32 can be used to provide substantial protection against shock loads resulting from the detonation of charges during perforating.

Depending on the specifics of a given drilling application or other type of application, the configuration of damper system 32 may be adjusted. In some applications, the sole use of vibration damper 42 may be sufficient while other applications may benefit from using various combinations of vibration damper 42, transverse shock damper 46, and axial shock damper 50. In a variety of applications, the damper system 32 combines vibration damper 42, transverse shock damper 46, and axial shock damper 50 to provide the desired protection against many types of shock loads and vibrations. Similarly, the various components of damper system 32 may be made from various suitable materials, including combinations of materials. In at least some downhole applications, damper system 32 provides desirable shock and vibrational damping when formed from silicone gel having the desired hardness for a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string comprising a plurality of components, at least one of the plurality of components including:

a housing having a tubing section bounded by a pair of bulkheads;

a mechanical chassis disposed within the housing between the bulkheads, the mechanical chassis being coupled to the housing by a damper system which allows the mechanical chassis to float within the housing, the damper system comprising:

a vibration damper providing a low-pass filter functionality with respect to vibration damping by coupling the mechanical chassis with the housing via a damper component extending between each bulkhead and the mechanical chassis;

a transverse shock damper disposed radially between the mechanical chassis and the tubing section at a location between the bulkheads; and an axial shock damper comprising a shock absorbing component positioned between each bulkhead and the mechanical chassis to protect the mechanical chassis against axial shock loads acting on the housing.

2. The system as recited in claim 1, wherein the vibration damper is formed from a silicone gel.

3. The system as recited in claim 1, wherein the transverse shock damper is formed from a silicone gel.

4. The system as recited in claim 1, wherein the axial shock damper is formed from a silicone gel.

5. The system as recited in claim 1, wherein the transverse shock damper comprises a plurality of shock absorbing bands disposed about the mechanical chassis at axial positions between vibration damper members.

6. The system as recited in claim 1, wherein the mechanical chassis comprises electronics potentially susceptible to vibration and shock loading.

7. The system as recited in claim 1, wherein the well string is a drill string comprising a while-drilling measurement system, the damper component protecting at least a portion of the while-drilling measurement system.

8. A system, comprising:

a metal mechanical chassis;

a metal housing disposed about the metal mechanical chassis at a position free from metal-to-metal contact;

a vibration damper coupling the metal mechanical chassis to the metal housing to serve as a mechanical low-pass filter reducing vibration influence on the metal mechanical chassis, the vibration damper comprising damper components extending from axial ends of the metal mechanical chassis to metal bulkheads of the metal housing;

a transverse shock damper positioned laterally between the metal mechanical chassis and the metal housing to further protect the metal mechanical chassis against shock loads incurred by the metal housing, the transverse shock damper being located between the damper components in an axial direction; and an axial shock damper separate from the vibration damper and the transverse shock damper, the axial shock damper being positioned to protect the metal mechanical chassis against axial shock loads acting on the metal housing.

9. The system as recited in claim 8, wherein the vibration damper and the transverse shock damper comprise a silicone gel.

10. The system as recited in claim 8, wherein the vibration damper comprises a rubber material.

11. The system as recited in claim 8, wherein the vibration damper comprises a urethane-based elastomeric material.

12. The system as recited in claim 8, wherein the metal housing is coupled into a drill string.

13. The system as recited in claim 12, wherein the metal mechanical chassis comprises electronics protected against vibration.

14. A method, comprising:

positioning a vibration sensitive component in a mechanical chassis;

mounting the mechanical chassis in a housing via a damper system;

providing the damper system with a vibration damper, a transverse shock damper, and an axial shock damper;

coupling the vibration damper to axial ends of the mechanical chassis to provide instantaneous transverse and axial shock damping with low-pass filter functionality while also providing attitude control with respect to the mechanical chassis;

using the transverse shock damper at a position radially between the mechanical chassis and the housing to suppress ringing effects;

independently using the axial shock damper to provide additional axial shock damping; and coupling the housing into a drill string.

15. The method as recited in claim 14, further comprising forming the vibration damper with a silicone gel.

16. The method as recited in claim 15, further comprising deploying the mechanical chassis in a drill string downhole for drilling a borehole along a desired trajectory.

* * * * *